US005482268A

United States Patent [19]

Driska

[11] Patent Number: 5,482,268

[45] Date of Patent: Jan. 9, 1996

[54] BUMPER FOR TABLE GAME

[75] Inventor: John J. Driska, Princeton Junction, N.J.

[73] Assignee: Azrak-Hamway International, Inc., New York, N.Y.

[21] Appl. No.: 990,721

[22] Filed: Dec. 15, 1992

[51] Int. Cl.[6] ..... A63D 15/06

[52] U.S. Cl. ..... 473/32

[58] Field of Search ..... 273/8, 9

[56] References Cited

U.S. PATENT DOCUMENTS

| | | | |
|---|---|---|---|
| 128,985 | 7/1872 | Stroup | 273/8 |
| 193,011 | 7/1877 | Mansur | 273/9 |
| 593,327 | 11/1897 | Neachem | 273/9 |
| 1,323,516 | 12/1919 | Acland | 273/9 |
| 3,733,072 | 5/1973 | Nielsen | 273/9 |
| 4,579,342 | 4/1986 | Mortensen | 273/8 |

*Primary Examiner*—Theatrice Brown
*Attorney, Agent, or Firm*—Amster, Rothstein & Ebenstein

[57] ABSTRACT

A bumper for a table game includes a rigid form defining a generally horizontal upper surface and a vertically extending inner surface depending from the form upper surface. A first plastic cover of a first rigidity is disposed on an outer marginal portion of the form upper surface and a second plastic cover of a second rigidity has a first portion disposed on an inner marginal portion of the form upper surface and a second portion disposed on the form inner surface. A plastic cushion of a third rigidity is disposed on the second portion of the second plastic cover. The second rigidity is greater than the third rigidity, and the second plastic cover and the cushion (and optionally the first plastic cover) are of integral, one-piece, unitary construction formed in a single co-extrusion operation.

15 Claims, 2 Drawing Sheets

FIG. 1
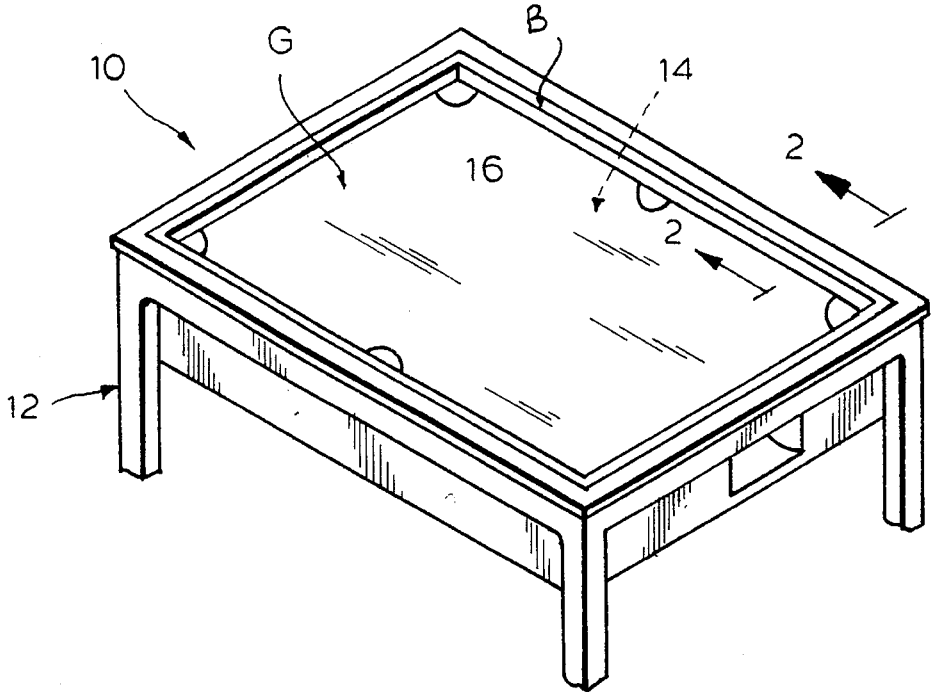
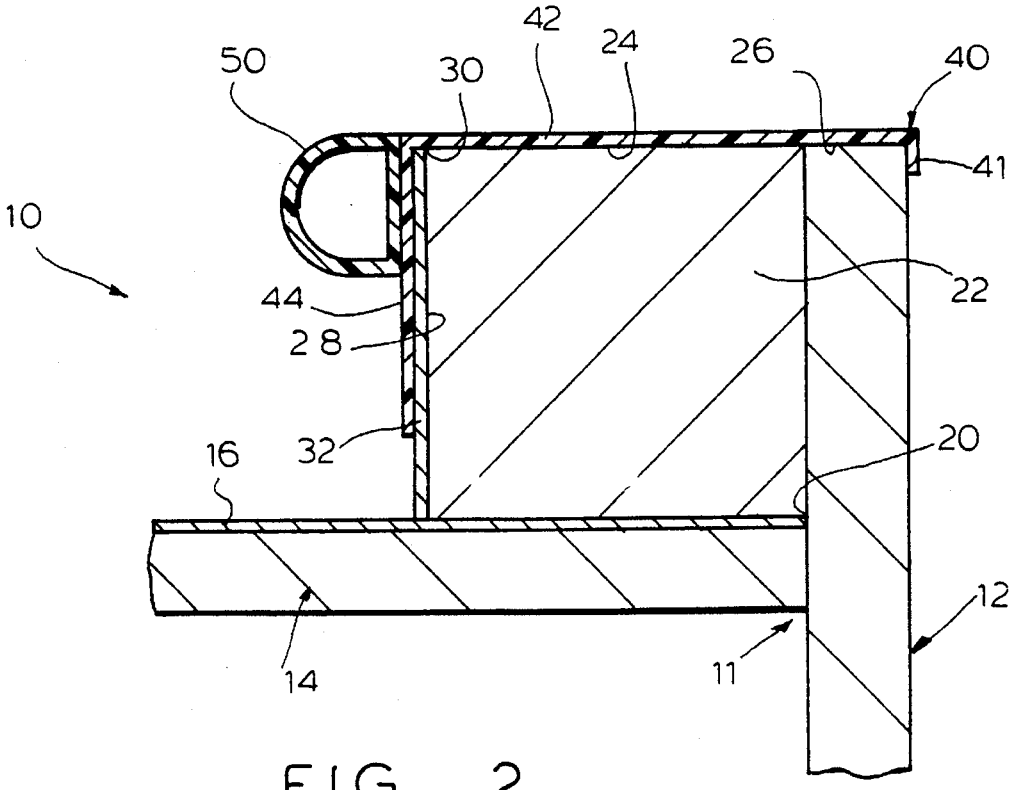
FIG. 2

FIG. 3
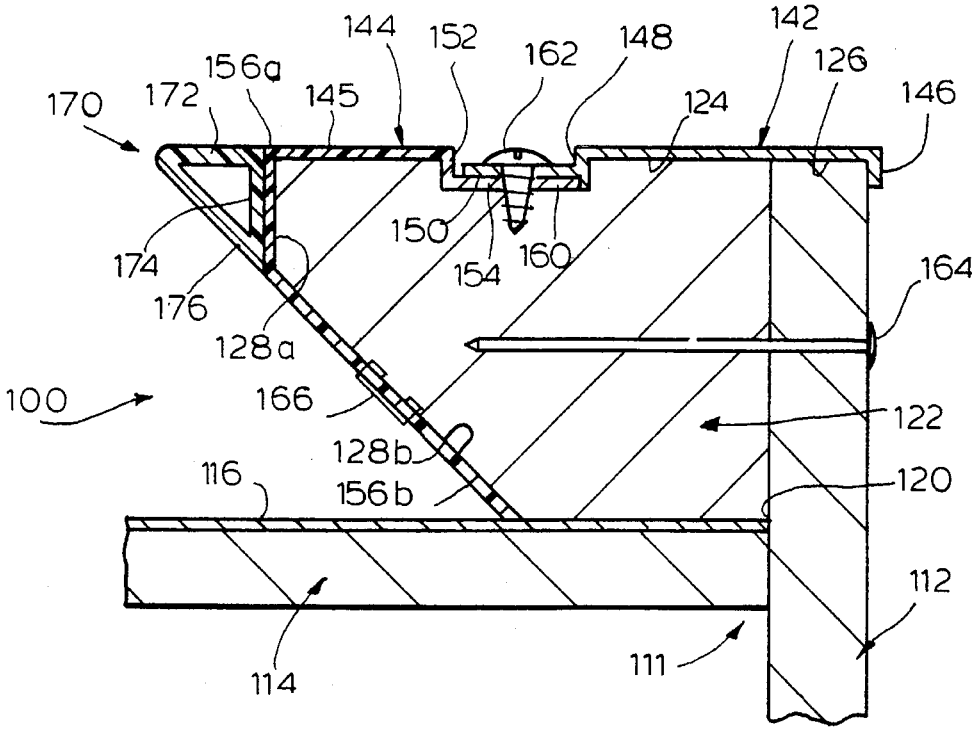
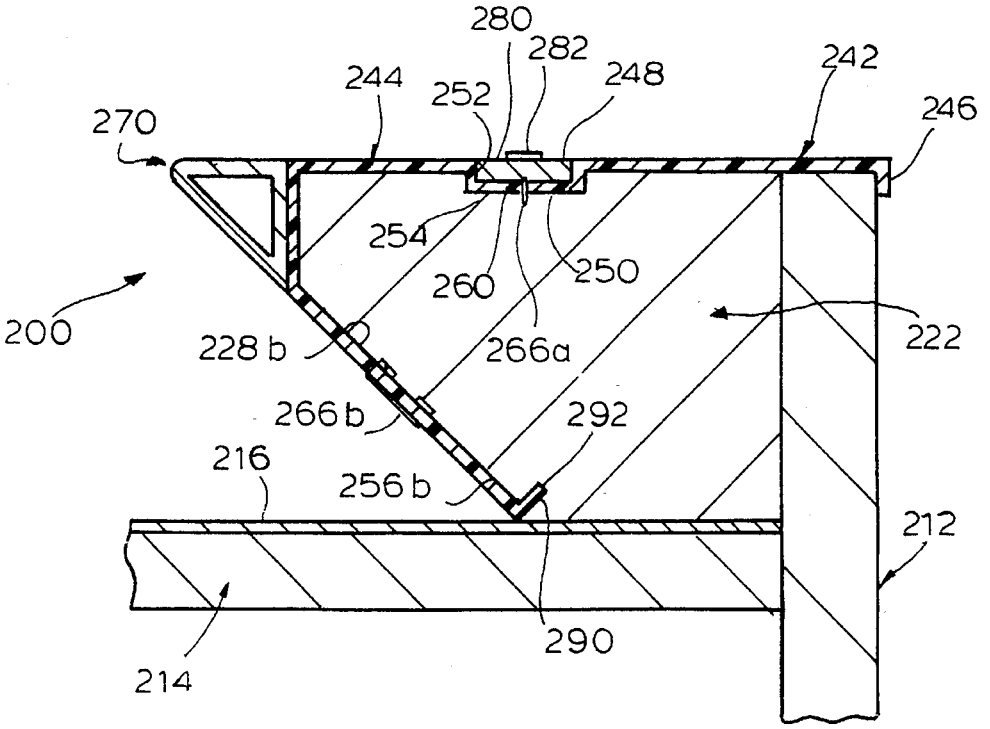
FIG. 4

BUMPER FOR TABLE GAME

BACKGROUND OF THE INVENTION

The present invention relates to a bumper for a table game such as pool or billiards and more particularly to such a bumper which can be economically manufactured.

In a table game such as pool, billiards or the like, the horizontal playing area over which the ball may travel has a perimeter defined either substantially or entirely by a bumper defining a resilient cushion. The innermost portion of the cushion is spaced sufficiently above the horizontal playing surface that, when impacted by a ball, it contacts the ball slightly above the horizontal centerline of the ball so that generally the ball does not bounce into the air and off the table (as it might if the contact were below the centerline of the ball). Preferably the cushion has a well-recognized level of resiliency which the skilled player relies upon for some of the more complex shots involving banking of the ball at least once off the cushion and frequently more than once. Generally speaking, the more skilled the player, the more importance is laid on the quality of the cushion.

On the other hand, the formation of the cushion-containing bumper is one of the more labor intensive, and thus more expensive, items in the manufacture of a pool or billiards table. In a conventional table, the cushion is first formed of foam or gum rubber and then secured to a vertically extending inner surface of the rigid wood form which defines the bulk of the table. The rubber and any remaining visible portion of the inner surface of the rigid wood form is then upholstered or covered with a felt or felt-like material which matches, and is preferably part of, the felt or felt-like material disposed on the generally horizontal playing surface. Typically the cushion has a triangular cross section so that more-or-less of a point contact is made with a ball impacting thereon. As the cushion must be able to withstand repeated shocks due to the balls impacting thereon (especially as there may be both vertical and horizontal spins on the impacting balls), great care must be taken in securing the rubber to the wood form and in securing the upholstery to the rubber. It will be appreciated by those skilled in the art that the creation of a bumper for a table game remains to a large degree a manual operation which, because of its time-consuming nature and because it requires the use of skilled labor, contributes substantially to the cost of the table game.

Accordingly, it is an object of the present invention to provide a table game bumper which can be economically manufactured.

Another object is to provide such a bumper which in a preferred embodiment not only appears like a conventional bumper, but produces substantially the same results.

SUMMARY OF THE INVENTION

It has now been found that the above and related objects of the present invention are obtained in a bumper for a table game comprising a rigid form defining a generally horizontal upper surface and a vertically extending inner surface depending from the form upper surface. A first plastic cover of a first rigidity is disposed on an outer marginal portion of the form upper surface, and a second plastic cover of a second rigidity has a first portion disposed on an inner marginal portion of the form upper surface and a second portion disposed on the form inner surface. A plastic cushion of a third rigidity is disposed on the second portion of the second plastic cover. The second rigidity is greater than the third rigidity, and the second plastic cover and the cushion are of integral, one-piece, unitary construction formed in a single co-extrusion operation.

In a preferred embodiment, the cushion is hollow and substantially resilient. In one embodiment, the cushion has a cross section which is substantially non-triangular (e.g., substantially "D" or rectangle shaped. In a preferred embodiment, however, the cushion has a cross section which is substantially triangular, and preferably substantially a right triangle, with an upper leg generally aligned with the first portion of the second plastic cover, an outer leg parallel to and covering at least a portion of the second portion of the second plastic cover, and a hypotenuse aligned with the remainder of the second portion of the second plastic cover. The first plastic cover, the second plastic cover, and the cushion are of integral, one-piece, unitary construction formed in a single co-extrusion operation.

Preferably the first plastic cover is of a first color, the second plastic cover is of a second color, and a second cushion is of a third color. The second and third colors are substantially the same color, while the first color is a different color. Optimally, the first color is wood-like, and the second and third colors are green.

In another preferred embodiment, the form upper surface defines a first recess and the form inner surface defines a second recess, the first and second plastic covers each having one edge thereof fixedly disposed in the first recess The first plastic cover at the other edge thereof includes a depending shoulder disposed over an outer vertically-extending surface of the form, and the second plastic cover has the other edge thereof disposed in the second recess. The second plastic cover is resilient and held in place on the form by the disposition of the one edge thereof in the first recess and the other edge thereof in the second recess.

BRIEF DESCRIPTION OF THE DRAWING

The above brief description, as well as further objects, features and advantages of the present invention, will be more fully understood by reference to the following detailed description of the presently preferred, albeit illustrative, embodiments of the present invention when taken in conjunction with the accompanying drawing wherein:

FIG. 1 is an isometric view of a table game with a bumper;

FIG. 2 is a fragmentary sectional view of a table game having a first embodiment of a bumper according to the present invention;

FIG. 3 is a fragmentary sectional view of a second embodiment of a bumper according to the present invention; and FIG. 4 is a fragmentary sectional view of a third embodiment of a bumper according to the present invention.

DETAILED DESCRIPTION OF THE PREFERRED EMBODIMENTS

Referring now to the drawing, and in particular to FIG. 1 thereof, therein illustrated is a table game G with a bumper B.

Referring now to FIG. 2, therein illustrated is a first embodiment of the bumper according to the present invention, generally designated by the reference numeral 10. The bumper 10 has a rigid form 11 which includes both a generally vertical sidewall generally designated 12 and a generally horizontal member generally designated 14 and defining the play area. The sidewall 12 and the horizontal member 14 may be formed of fibreboard, wood or like substantially rigid materials such as flakeboard. The upper surface of the horizontal member 14 is provided with a felt or felt-like cover 16 in order to provide a desirable playing surface over which the ball may travel.

The outer marginal portion of the horizontal member 14 and the upper portion of the sidewall 12 extending thereabove together define a corner 20 which receives a rigid block 22 as part of the form 11. Block 22 is preferably formed of medium density fiberboard wood or like rigid material. The block 22 defines a generally horizontal upper surface 24 (typically horizontally aligned with the generally horizontal upper surface 26 of the sidewall 12), a vertically extending inner surface 28 depending therefrom (here illustrated as a vertical surface parallel to sidewall 12), and a corner 30 formed by the intersection of the upper and inner surfaces 24, 28 of the block 22. Optionally, the vertically extending inner surface 28 of the block 22 is, at least where visible in the finished bumper, provided with a layer of material 32, preferably paint, which is similar to the felt or felt-like material 16 in general appearance and, in particular, in color.

A plastic cover generally designated 40 .and having a first rigidity is disposed on the form 11 with a horizontal portion 42 disposed on and substantially completely covering the form upper surface, including the inner marginal portion of the form upper surface defined by the block upper surface 24 and the outer marginal portion of the form upper surface defined by the sidewall upper surface 26. The cover 40 includes an outer shoulder 41 depending from an outer edge of the cover horizontal portion 42 so as to cover the top portion of the form outer surface and a typically longer inner shoulder 44 depending from an inner edge of the cover horizontal portion 42 so as to cover at least a substantial segment of the block inner surface 28 or, as illustrated, the felt or felt-like material 32 disposed thereon. The plastic cover 40 is preferably as rigid as the sidewall 12 and block 22 of the form 11 so that it may be easily secured to the form 11 at the corners of the table, with the portions thereof intermediate the corners remaining in place due to the rigid nature of the cover 40.

A plastic cushion 50 is disposed on the inner surface of inner depending shoulder 44 of the plastic cover 40, adjacent the upper horizontal surface 42 thereof. The cushion 50 is preferably hollow and substantially resilient. Its rigidity is less than that of the plastic cover 40—in another words, its resiliency is greater. The cross section of cushion 50 is substantially non-triangular and is preferably substantially "D" or rectangle-shaped, with the flat portion of the "D" abutting the inner depending shoulder 44 of cover 40 and the curved portion of the "D" facing inwardly to provide a ball rebound surface.

The plastic cover 40 and the plastic cushion 50 are of integral, one-piece, unitary construction formed in a single co-extrusion operation. In other words, as the two components 40, 50 are being formed from the molten plastic materials being extruded into a mold, the two components 40, 50 intimately contact while they are still in the molten state. Thus, the two streams of molten material may contact either before or after entering into the mold. No further means are required for securing together the plastic cover 40 and the plastic cushion 50. Accordingly, the cushion 50 is easily, economically, and automatically affixed to the form 11 with plastic cover 40. The plastic cover 40 may be secured to the form 11, for example, by staples, nails, glues or other means.

The plastic cover 40 is preferably dark brown or wood-colored so as to provide a contrast with the green of the felt or felt-like materials 16, 32. The color of the plastic cushion 50 is preferably green, not necessarily the same green as the felt or felt-like material 16, 32, but in the same general family and contrasting with the dark brown or wood-like color of the plastic cover 40.

It will be appreciated by those skilled in the art that the first embodiment 10 provides a bumper which is relatively economical to manufacture and which provides a relatively attractive appearance somewhat resembling that of a conventionally manufactured bumper, but yet one which is easily distinguishable therefrom both aesthetically and functionally since the cushion rebound differs from that provided by a conventional cushion due to the differences in shape thereof. Nonetheless, the first embodiment 10 enables the combined cover 40/cushion 50 to be applied as a unit to the form 11, thereby greatly reducing manufacturing costs by eliminating much of the skilled hand labor involved in conventionally applying rubber to the form and then upholstering the rubber. For many players, the rebound afforded by embodiment 10 is indistinguishable from that of a conventional bumper.

Referring now to FIG. 3, therein illustrated is a second embodiment of the present invention, generally designated 100. As in the first embodiment 10, the rigid form 111 includes a sidewall generally designated 112 and a horizontal member generally designated 114 defining the playing area. The horizontal member 114 is preferably covered with a felt or felt-like material 116 over which the ball may travel. Disposed in the corner 120 is a block generally designated 122, the upper surface 124 of the block 122 being co-planar with the upper surface 126 of sidewall 112 except for an open-topped recess 160 (the function of which will be described hereinafter). Whereas the inner surface 28 of block 22 of the first embodiment 10 was planar, and indeed vertical, the inner surface of the block 122 defines an upper inner surface **128*a* which is substantially vertical and a lower inner surface 128*b* which slopes downwardly and outwardly from the bottom of the upper inner surface 128*a* down to the bottom of the block 122 and, more particularly, the horizontal member 114 or the felt or felt-like material 116 over that horizontal member 114. Block 122 may be glued or adhered to the sidewall 112, but is preferably secured thereto by means of a nail 164**, as illustrated.

Instead of the single plastic cover 140 of the first embodiment 10, the second embodiment 100 has a first plastic cover 142 of a first rigidity disposed on an outer marginal portion of the form upper surface, and a second plastic cover generally designated 144 of a second rigidity having a substantially horizontal upper portion 145 disposed on an inner marginal portion of said form upper surface and a vertically-extending lower portion 156 disposed on the form inner surfaces **128*a*, 128*b*. The first plastic cover 142 defines at an outer edge thereof a depending generally vertical shoulder 146 which covers a top portion of the outer surface of sidewall 112, and at an inner edge thereof a depending generally vertical shoulder 148 which has an inwardly extending generally horizontal flange 150 at the free edge thereof. The second plastic cover 144 has at an outer edge of its horizontal portion a depending generally vertical shoulder 152 which has an outwardly extending generally horizontal flange 154. The outwardly-extending flange 154 of the second plastic cover 144 and the inwardly-extending flange 150 of the first plastic cover 142 are typically overlapping. Alternatively, one of the flanges 150, 154** may be dispensed with.

The block 122 defines an open-topped recess 160 which is configured and dimensioned to receive the downwardly depending shoulders 148 and 152 of the first and second plastic covers 142, 144, respectively, including flanges 150, 154. The depending shoulders 148, 152 may be glued or otherwise secured to the recess 160. For example, as illustrated, a self-tapping screw 162 passes through the overlapping flanges 150 and 154 of the first and second plastic covers 142, 144, respectively, eventually biting into the wood of block 122 defining recess 160.

The other or vertically-extending edge 156 of the second plastic cover 144 includes a first or substantially vertical portion 156*a*, which extends downwardly over the substantially vertical face 128*a* of block 122, and a second or vertically sloped portion 156*b*, which extends downwardly and outwardly over the similarly sloped face 128*b* of block 122. The sloped portion 156*b* of the second plastic cover 144 is glued, adhered or otherwise secured to the sloped surface 128*b* of the block 122, for example, by use of a staple 166, as illustrated.

A plastic cushion generally designated 170 of a third rigidity is disposed on the first or substantially vertical portion 156*a* of the vertically-extending edge 156 of the second plastic cover 144—that is, the portion of the second plastic cover 144 covering the substantially vertical face 128*a* of block 122. The cushion 170 has a cross section which is substantially triangular and preferably substantially a right triangle, with an upper leg 172 generally aligned with the horizontal portion 145 of the second plastic cover 144, a substantially vertical leg 174 disposed on the substantially vertical upper portion 156*a* of the second plastic cover 144 covering block surface 128*a*, and a hypotenuse 176 generally aligned with the second or sloped portion 156*b* of the second plastic cover 144 disposed on the block sloped surface 128*b*. The cushion 170 is preferably hollow, although ribs or the like may be provided to ensure that it has the proper rigidity. The cushion 170 is substantially resilient, more than the second cover 144, and preferably more than both the first and second plastic covers 142, 144, when disposed on the block 122.

The second plastic cover 144 and the cushion 170 are of integral, one-piece, unitary construction formed in a single co-extrusion operation, like the analogous components 40, 50 of the first embodiment 10. However, because the cushion 170 has a cross section which is substantially triangular, despite its hollow construction, it has greater rigidity than the non-triangular cushion 50 of the first embodiment 10 and therefore can provide a banking function which is more closely analogous to that of a conventional bumper. As in the case of the first embodiment 10, in the second embodiment 100 the co-extruded nature of the cushion 170 and the plastic cover 144 provides a joint which will not separate even under repeated shock from impinging balls.

The first plastic cover 142 is preferably of a dark brown or wood-like color and typically has a rigidity similar to that of the rigid form 111. The second plastic cover 144 and the cushion 170 are preferably the same color, both preferably being green and therefore different from the dark brown or wood-like color of the first plastic cover 142.

The triangular shape of the cushion 170 and the continuation of the hypotenuse or sloped surface 176 of the cushion 170 in a plane with an adjacent sloped portion 156*b* of the second plastic cover 144, when taken in conjunction with the suggested use of dark brown wood-like coloring and green felt-like coloring, provides a visual appearance for the bumper which closely resembles that of a conventional bumper formed of wood, rubber and felt. The second embodiment combines this close visual simulation with an accurate banking function simulation to provide a bumper which is economical to manufacture but simulates in both appearance and function the more expensive conventional bumper. Such a close simulation of a conventional bumper is not possible in the first embodiment 10 because the non-triangular cushion 50 does not provide a comparable banking function to the conventional cushion and because there is only a single color material over the form upper surfaces 24, 26. (While the plastic cover 40 may be considered to be formed of a first plastic cover disposed on the outer marginal portion of the form upper surface and a second plastic cover disposed on the inner marginal portion of the form upper surface and the form inner surface, the two plastic covers are formed in a mono-extrusion operation and thus are necessarily of the same color.)

Referring now to FIG. 4, therein illustrated is a third embodiment of the present invention, generally designated 200. The third embodiment 200 differs essentially from the second embodiment 100 only in that the first plastic piece, here generally designated 242, the second plastic piece, here generally designated 244, and the cushion, here generally designated 270, are of integral, one-piece unitary construction formed in a single co-extrusion operation (which is actually a tri-extrusion operation). Thus the flange 250 of the first plastic cover a section of 242 and the flange 254 of the second plastic cover a section of 244 are disposed at the same level so that they abut and are joined to one another edge-to-edge for disposition within the recess 260 of block 222.

Preferably a staple 266*a* has one pointed leg penetrating a respective flange 250, 254 of each of the plastic cover sections of 242, 244 and securing it to the block 222. The presence of the staple 266*a* is preferably concealed by a separately manufactured snap-in element 280 which is adapted to snap into recess 260 and be maintained therein by the depending leg 248 of the inner edge of the first plastic cover a section of 242 and the depending leg 252 of the outer edge of the second plastic cover a section of 244, which legs 248, 252 cooperatively receive and maintain the snap-in element 280 in place in recess 260. The snap-in element 280 is typically provided with a series of printed or raised diamonds 282 on the upper surface thereof to facilitate use of the cushions, the diamonds 282 being equidistantly spaced along the length of the snap-in element 280. The snap-in element 280 is preferably extruded or injection molded. It will be appreciated by those skilled in the art that the snap-in element 280 illustrated in FIG. 3 may be utilized with minor modifications in the recess 160 of the second embodiment 100 illustrated in FIG. 2, thereby to conceal the screw 162 and provide the function of the diamonds 282. (Alternatively, in the second embodiment 100 the heads of the screws 162, or appropriate covers provided therefor, may be diamond-shaped.)

As in the second embodiment 100, a staple, here 266*b* may be used to secure the sloped portion 256*b* of the second plastic cover a section of 244 to the block 222. However, in order to reduce the need for stapling and for concealing any staples that are used, the vertically extending portion of the second plastic cover a section of 244 may be provided with a free end 290 adapted to be resiliently received by and maintained within an appropriate groove 292 in the block. The groove 292 may be provided in the block bottom surface 294 or the block sloped portion 228*b*, as illustrated. In this instance, the second plastic cover a section of 244 must be somewhat resilient and not exclusively rigid, so that it may be expanded sufficiently by the manufacturer to allow the edges 252 and 290 thereof to enter into the appropriate recesses or grooves 260 and 292, respectively. Thus, the rigidity of such a second plastic cover a section of 244 may be intermediate that of the first plastic cover 242 and the cushion 270.

The composite of the first and second plastic cover sections of 242, 244 of the third embodiment 200 is to be distinguished from the plastic cover 40 of the first embodiment 10. Because the plastic cover 40 is a mono-extrusion in the first embodiment 10 (even though it is a part of a co-extrusion including cushion 50), it is necessarily formed of the same material and characterized by the same color and rigidity (except as the rigidity may vary with the thickness of particular portions thereof). By way of contrast, because the first and second plastic cover sections of 242, 244 of the third embodiment 200 are co-extruded (actually tri-extruded along with the cushion 270), each can be made of a different material and the color and rigidity of each plastic cover may differ (without regard to the thickness of particular portions thereof).

While the various plastic components—that is, the first plastic cover, the second plastic cover, and the cushion—may be made of different plastic materials, preferably they are made of the same general plastic material but using differing amounts of plasticizer and the like to effect different rigidities. A preferred plastic material is polyvinyl chloride, which is naturally fairly rigid and may be made resilient to differing degrees through the appropriate use of plasticizers, as is well known by those skilled in the plastic molding arts.

To summarize, the present invention provides a table game bumper which can be economically manufactured but, in a preferred embodiment, not only appears like a conventional bumper but produces substantially the same results.

Now that the preferred embodiments of the present invention have been shown and described in detail, various modifications and improvements thereon will become readily apparent to those skilled in the art. Accordingly, the spirit and scope of the present invention is to be construed broadly and to be limited only by the appended claims, and not by the foregoing specification.

I claim:

1. A bumper for a table game, comprising:

(A) a rigid rail form defining a generally horizontal upper surface and an inner surface depending from said form upper surface, said upper surface having inner and outer marginal sections, said inner surface having an upper vertically-extending portion and a lower portion;

(B) a plastic cover having a first section disposed on said outer marginal section of said, form upper surface and a second section of a first rigidity disposed on said inner marginal section of said form upper surface, said upper vertically-extending portion of said form inner surface and said lower portion said form inner surface, said second section of said plastic cover having a vertically-extending portion; and (C) a plastic cushion of a second rigidity disposed on said vertically-extending portion of said second section of said plastic cover, said first rigidity being greater than said second rigidity; and said second section of said plastic cover and said cushion being of integral, one-piece, unitary construction formed in a single co-extrusion operation.

2. The bumper of claim 1 wherein said cushion is hollow and substantially resilient.

3. The bumper of claim 1 wherein said cushion has a cross section which is substantially non-triangular.

4. The bumper of claim 3 wherein said cushion has a cross section which is substantially "D" or rectangle shaped.

5. The bumper of claim 1 wherein said cushion has a cross section which is substantially triangular.

6. The bumper of claim 5 wherein said cushion has a cross section which is substantially a right triangle, with an upper horizontal leg generally aligned with a first portion of said second section of said plastic cover, an outer leg parallel to and covering at least a second portion of said second section of said plastic cover, and a hypotenuse aligned with a third portion of said second section portion of said plastic cover.

7. The bumper of claim 6 wherein said lower portion of said form inner surface and said third portion of said plastic cover is inclined relative to said vertically-extending portion.

8. The bumper of claim 1 wherein said first section of said plastic cover is of a first color, said second section of said plastic cover is of a second color, and said cushion is of a third color; said second and third colors being substantially the same color while said first color is a different color than said second and third colors.

9. The bumper of claim 8 wherein said first color is brownish, and said second and third colors are green.

10. The bumper of claim 1 wherein said form upper surface defines a first recess, and said first and second sections of said plastic covers each have one edge thereof fixedly disposed in said first recess.

11. The bumper of claim 10 wherein said form inner surface defines a second recess, and said second section of said plastic cover has another edge thereof disposed in said second recess, said second section of said plastic cover being resilient and held in place on said form by the disposition of said one edge thereof in said first recess and said another edge thereof in said second recess.

12. The bumper of claim 11 wherein said first section of said plastic cover at the other edge thereof includes a depending shoulder disposed over an outer vertically-extending surface of said form.

13. A bumper for a table game, comprising:

(A) a rigid rail form defining a generally horizontal upper surface and an inner surface depending from said form upper surface, said upper surface having inner and outer marginal sections, said inner surface having an upper vertically-extending portion and a lower portion;

(B) a plastic cover having a first section disposed on said outer marginal section of said form upper surface and a second section of a first rigidity disposed on said inner marginal section of said form upper surface, said upper vertically-extending portion of said form inner surface and said lower portion of said form inner surface, said second section of said plastic cover having a vertically-extending portion; and (C) a plastic cushion of a second rigidity disposed on said vertically-extending portion of said second section of said plastic cover, said cushion having a cross section which is substantially a right triangle, with an upper horizontal leg generally aligned with said first portion of said second section of said plastic cover, an outer leg parallel to and covering at least a second portion of said second section of said plastic cover, and a hypotenuse aligned with a third portion of said second section of said plastic cover; said cushion being hollow and substantially resilient;

said first rigidity being greater than said second rigidity; and said second section of said plastic cover and said cushion being of integral, one-piece, unitary construction formed in a single co-extrusion operation.

14. The bumper of claim 13 wherein said first and second sections of said plastic cover and said cushion are of integral, one-piece, unitary construction formed in a single co-extrusion operation.

15. The bumper of claim 13 wherein said form upper surface defines a first recess and said form inner surface defines a second recess, said first and second segments of said plastic cover each have one edge thereof fixedly disposed in said first recess, said first segment of said plastic cover at the other edge thereof includes a depending shoulder disposed over an outer vertically-extending surface of said form, and said segment of said plastic cover has the other edge thereof disposed in said second recess, said second segment of said plastic cover being resilient and held in place on said form by the disposition of said one end thereof in said first recess and said other edge thereof in said second recess.

* * * * *